United States Patent [19]

Prohs

[11] Patent Number: 4,496,022

[45] Date of Patent: Jan. 29, 1985

[54] SYSTEM FOR INTERRELATING SOUND TRANSDUCERS OR SOUND SOURCES AND THEIR ENVIRONMENT

[76] Inventor: John R. Prohs, 233 S. Orange Grove Blvd., Apt. 233, Pasadena, Calif. 91105

[21] Appl. No.: 468,850

[22] Filed: Feb. 22, 1983

[51] Int. Cl.[3] ..... G10K 11/00

[52] U.S. Cl. ..... 181/175; 181/296

[58] Field of Search ..... 181/175, 296, 30; 381/24, 90; 362/809; 434/131, 284–294; 355/47; 350/127, 128

[56] References Cited

PUBLICATIONS

McCarthy, Loudspeaker Arrays–A Graphic Method of Designing, 1978.

Uzzle, Loudspeaker Coverage by Architectural Mapping, Jun. 1982.

Malmlund; An Optical Aid for Designing Loudspeaker Clusters, Oct. 12, 1964.

Seeley, Innovations in a Stadium Sound System Designs, May 1978.

*Primary Examiner*—John Gonzales

*Assistant Examiner*—Brian W. Brown

[57] ABSTRACT

A system for determining optimal selection and positioning of transducers (e.g., loudspeakers or microphones) in an acoustical environment, and relating an acoustic environment to any sound source. The system determines the acoustical dispersion pattern, and the sensitivity or power requirements for transducers or sound sources.

The system involves mapping acoustical environment, as viewed from a specific location, in true angles and with attenuation information, onto the surface of a sphere. The transducer or sound source is related to this mapped environment by mapping its angular sensitivity or radiating pattern onto an overlay which is manipulated over the surface of the sphere.

A system light source permits the information depicted on the sphere to be projected onto a scale model. Final documentation of all interrelationships may be viewed on the system sphere, or photographed from a system screen.

16 Claims, 7 Drawing Figures

SYSTEM FOR INTERRELATING SOUND TRANSDUCERS OR SOUND SOURCES AND THEIR ENVIRONMENT

BACKGROUND OF THE INVENTION

The following discussion emphasizes the application of this invention to the design of loudspeaker systems. The system, however, is not limited in application to loudspeaker selection and positioning.

Loudspeaker systems may be classified into the two general categories of distributed systems and central systems. All other loudspeaker systems are variations on or combinations of the two. The central system locates a cluster or array of loudspeakers at one point, typically above the actual sound source. This system provides a greater sense of realism than the distributed system (absent use of sophisticated time delay devices), because the listener perceives the amplified sound as coming from the direction of the natural sound.

Design of a central system involves coverage of a given space with multiple loudspeaker units. Location and orientation, the angular and rotational placement of each loudspeaker, is important. Haphazard placement of component loudspeakers can result in excessively loud, low, or unintelligible sound in certain areas of the room. Since a loudspeaker system is a costly and significant item in a sound system, a way is needed to determine the best types of loudspeakers for the site, and the most effective way of orienting individual components with respect to a loudspeaker cluster and to the given room.

Many developments have been made in measurement techniques which describe the acoustical environment. By utilizing these developments, such factors as distortion, acoustical gain, and intelligibility can be measured and calculated relatively easily. But one of the most critical design factors of all, the orientation of the loudspeaker within a cluster, has lagged behind.

Descriptive-geometry drafting techniques have been used in the design of speaker systems, but such solutions cannot usually be obtained by showing the three principal views (front, top and side) which are used in orthographic projection. Many solutions require auxiliary views or revolution. This drawing process, as applied to the intersection of complex surfaces of an acoustical environment, and to the patterns of a source or receiver of sound, is very tedious to implement, time consuming and complicated. Furthermore, if the position of any element is to be moved, the entire process must be repeated for that component, and, in the course of designing, each cluster component may be moved several times before finding a correct orientation.

A projector which beams light through a template orifice to produce light patterns on a scale model has also been utilized, but only one loudspeaker coverage pattern at a time can be displayed, and loudspeaker interactions are not apparent. Another limitation is that the scale models take a significant amount of time to build. In addition, the model and the projector together are cumbersome to carry back and forth from office to site.

Recently, as an outgrowth of the increased information on sound coverage available, coupled with the advent of powerful programmable calculators and micro-computers, two-diminsional angular-mapping techniques have been devised. Their aim is to display the room as viewed from the loudspeaker cluster, to provide greater accuracy in component positioning, and in prediction of sound dispersion. The typical procedure is to measure the room, compute the data and make the necessary spherical to rectangular coordinate transformations, and to map the room on polar plot or graph paper. The commercially available speaker patterns —or the designer's own—are typically made of materials such as clear Mylar. These are shifted around over the room plot until the best coverage ascertainable from the method is achieved.

However, an axiom of cartography is that the only true map is a globe (a sphere). Transformations from a sphere to a flat two-dimensional surface attempt to minimize distortions as much as possible, but there is no such thing as a distortion-free flat map. If one attempts to flatten a sphere-like object (such as a child's rubber ball with surface designs) a clear idea of what happens in flat mapping can readily be seen. In any type of two-dimensional mapping, one or more of the following errors will occur. The scale of the map will be inaccurate, except along only one or two parallels or meridians, and angular relationships are not retained; or, relative sizes or shapes are distorted.

With two-dimensional mapping of loudspeaker clusters, the inevitable distortions cause the generated loudspeaker overlay to be accurate at only the area for which it is generated (and therefore inaccurate at all other positions), or require awkward and complex manipulations over the discontinuous two-dimensional map in order to see its true coverage pattern.

Accordingly a major object of this invention is to provide an improved means for designing a sound-system. Included within this broad purpose are the following specific objectives. With this invention, a sound system designer can "map" the entire listening area (including related architecture) onto a sphere without the distortion inherent in a two-dimensional transform of the same. Because overlays depicting the actual coverage of a loudspeaker can now be placed on this spherical map, and moved to any position or rotation with complete accuracy, it is possible to visualize immediately the loudspeaker's coverage anywhere.

The interaction of all loudspeaker components of a cluster can be readily seen. The attenuation contours of each loudspeaker can be compared to the inverse-square losses in the architectural surroundings to angle the loudspeaker into its optimum position, and to determine how much power is needed to deliver a desired direct sound pressure level. With available software, a system can be designed very rapidly, either in the field or in the office with equipment fitting into a standard attache case. The ultimate benefits of this technique expand beyond a more accurate sound system, to a more cost-effective sound system, and to a minimal-component sound system.

SUMMARY OF THE INVENTION

This invention relates to the selection and positioning of one or more radiant-energy transducers in an environmental volume. In the specific configuration disclosed, the invention is directed to a system for selection and positioning of loudspeakers which radiate sound from a central cluster to the seating areas of an auditorium, grandstand, or similar acoustical environment.

The invention is implemented by first mapping on a spherical surface the outline of the seating areas as viewed from the center of the sphere which simulates the point of origin of sound waves emanating from the loudspeakers. The seating areas are conveniently mapped in terms of longitude and latitude coordinates on the spherical surface, and distance or range from the center of the sphere to various points of the overall seating area is plotted in the form of contour lines. While the contour lines can display direct linear distances (e.g., 50 feet, 75 feet, etc.), the lines are preferably calibrated in decibels to show distance in terms of the decrease or inverse-square attenuation of sound intensity as the spherical sound waves radiate from the speaker cluster (i.e., the center of the plotting sphere) to the various points of the seating area.

The next step is to map the sound field radiated by each speaker individually on a transparent sheet which is spherically curved to mate with the contour of the outer surface of the sphere on which the listening-area contours are plotted. Each speaker map displays the perimeter of the sound field (typically a roughly oval pattern as radiated from a speaker horn) at a plurality of ranges as calibrated in decibels to read directly against the distance or range lines of the seating area as plotted on the sphere. The central axis of the sound field is also marked to provide an "aiming line" for the speaker.

In a single-speaker system, the speaker overlay is then positioned against the spherical surface of the listening-area plot, and moved until the best possible sound coverage of the listening area is displayed by the superimposed plots. The longitude and latitude of the speaker axis or aiming line is then read directly from the sphere to provide information needed to aim the speaker toward the actual listening area. Power requirements for the speaker are determined by comparing the reference-level decibel-calibrated speaker contours with the listening-area range lines. The speaker power in watts to provide a desired sound pressure level at specific points in the seating area is readily calculated using standard techniques.

The more common application involves positioning of multiple speakers mounted in a central cluster, and the invention is well adapted to solving this problem. The individual speaker maps are juxtapositioned (and typically overlapped) to provide the desired coverage and sound intensity at the seating area.

Although described in terms of using a globe-like physical plot of the seating area with the spherically curved speaker-plot sheets, these components can be simulated on a computer-graphics display, with suitable programming to enable adjustment of position of the speaker plots until optimum sound coverage is obtained. The essence of the invention is the same in these several applications, and in similar applications such as selection and positioning of microphones in a performance area. Distortion-free overlaying of sound fields on the environmental volume is assured by mapping the speaker and space characteristics on mating spherical surfaces.

The overlayed plots can be projected on a flat surface to be photographed for permanent-record purposes. The contours are distorted by such projection, but perfect fidelity of overlapped points of the superimposed maps is maintained in the two-dimensional image. This is so because the superimposed maps are distorted equally and simultaneously during projection, but individual overlapped points on the maps remain perfectly overlapped in the image.

DESCRIPTION OF THE PREFERRED EMBODIMENT

The sound wave that comes out of a loudspeaker is a spherical wavefront or segment thereof. Since this wavefront is accurately depicted only on a sphere, some manufacturers have reputedly used spheres for such representations. However, the present invention not only relates the loudspeaker to the sphere, but also relates the room to the sphere. Since both are on the sphere, the sound radiations emanating from the loudspeaker can be envisioned just as they will be in the actual room or acoustical environment. This becomes an extremely useful tool for cluster designing.

Figure 1:
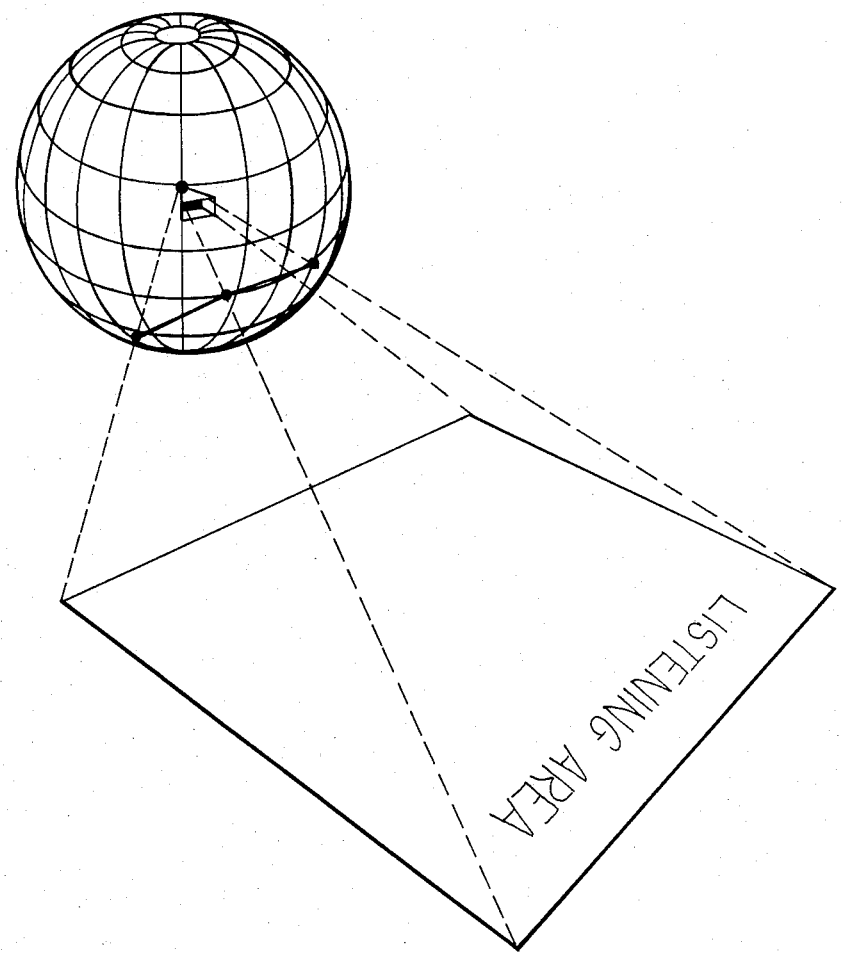
FIG. 1 is a pictorial view showing the mapping of an acoustical-environment listening area onto the surface of a sphere having a loudspeaker at its center.

When using this system, everything is viewed from the loudspeaker cluster's vantage. To grasp this concept, envision someone at the center of a transparent hollow sphere etched with a grid of longitudinal and latitudinal lines. The perspective is equivalent to standing at the center of the loudspeaker cluster. As the observer looks through the sphere, each location in the room can be marked as a unique point on the surface of the sphere. As the room is viewed, the observer could hold a pen in his hand and trace the outline of all the listening areas onto the sphere's interior. The result is a complete picture drawn on the sphere, showing how the area appears from this viewpoint as shown in FIG. 1. This is in essence how the seating area would appear from the loudspeaker cluster's perspective.

A way to relate the loudspeaker to the room map is now needed. To understand this, envision one of the loudspeakers, with its acoustical apex at the center of the sphere, radiating sound intensities which can be measured. The results can be displayed as a pattern, very much like elevation is depicted with contour lines on a topographical map (see FIGS. 3 and 7). This pattern is also traced onto the sphere's surface.

At this point, the sphere has on its surface both the room map and the contour pattern of the loudspeaker representing the exact angular coverage in each attenuation curve. However, since the angular position of this contour changes as the loudspeaker's position is varied, a way is needed to move the contour about over the outline of the room. To do this, the contour pattern is transferred to a thin, clear spherical overlay that conforms to the surface of the sphere. The overlay can then be moved to any location to allow the designer to choose optimum positioning.

It is also necessary to add the element of distance to the angular information already on the sphere. Distance for sound can be thought of in several ways: time; attentuation (reduction in direct sound); or range (as expressed in feet or meters). All are different ways of expressing the same thing. It takes sound a specific time to travel a given distance. One could say something is a certain number of milliseconds away. Likewise, a spherical wavefront attenuates direct sound levels a certain amount in decibels from a reference; a point can be said to be a certain number of db away. Keeping the units in decibels makes it very convenient to relate the room seating areas to the loudspeaker cluster. With this information traced on the sphere, our view from the loudspeaker cluster's perspective is complete.

A calculating means exists for supplying information needed to map the acoustical environment on the sphere. After this angular and attentuation information is plotted on the sphere surface with a suitable pen, the loudspeaker coverage overlays are selected and positioned on it.

The exact position of each loudspeaker in the final cluster configuration can easily be read directly from the calibrated sphere. The vertical and horizontal angles read directly off the sphere are the same ones to which each real loudspeaker in the room is oriented to achieve the same uniformity and pattern of coverage that is designed on the spherical model. If a loudspeaker coverage overlay is rotated to better fit the acoustical environment, then that rotation angle can be directly read off the sphere as measured from any longitudinal or latitudinal line.

The following applications show the versatility of the design techniques when applied to more intensive acoustical investigation, or when desired as a teaching or selling aid.

Figure 6:
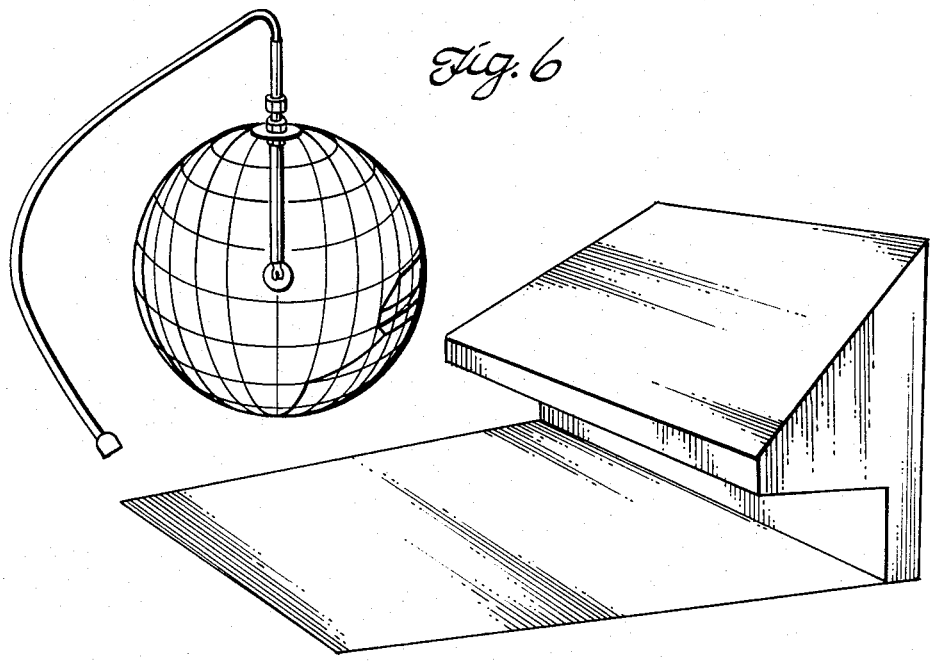
FIG. 6 is a pictorial view showing the sphere and light source positioned to project the sphere markings onto an architectural model of a seating area which includes a main floor and a balcony.

The spherical model can be used as a projector with a scale architectural model or floor plan as shown in FIG. 6. If used with a scale model with mirrored surfaces, even the effects of acoustical reflections can be seen. Projection onto a model also serves as a method for exact verification of all plotting.

In order to use the sphere as a projector, a lamp assembly is clipped to the sphere and the sphere assembly is attached to a stand which can support it over the scale model. The sphere at this point already has the room mapped on it, and the loudspeaker coverage overlays in their intended position. The sphere's center, where the filament of the bulb has been adjusted to be, is then put into the exact scale position where the loudspeaker cluster will be positioned. For example, if the loudspeaker cluster is to be 40 feet high in the room, and the model used a scale of one-fourth inch equals one foot, the center of the sphere would be positioned ten inches above the model.

Figure 7:
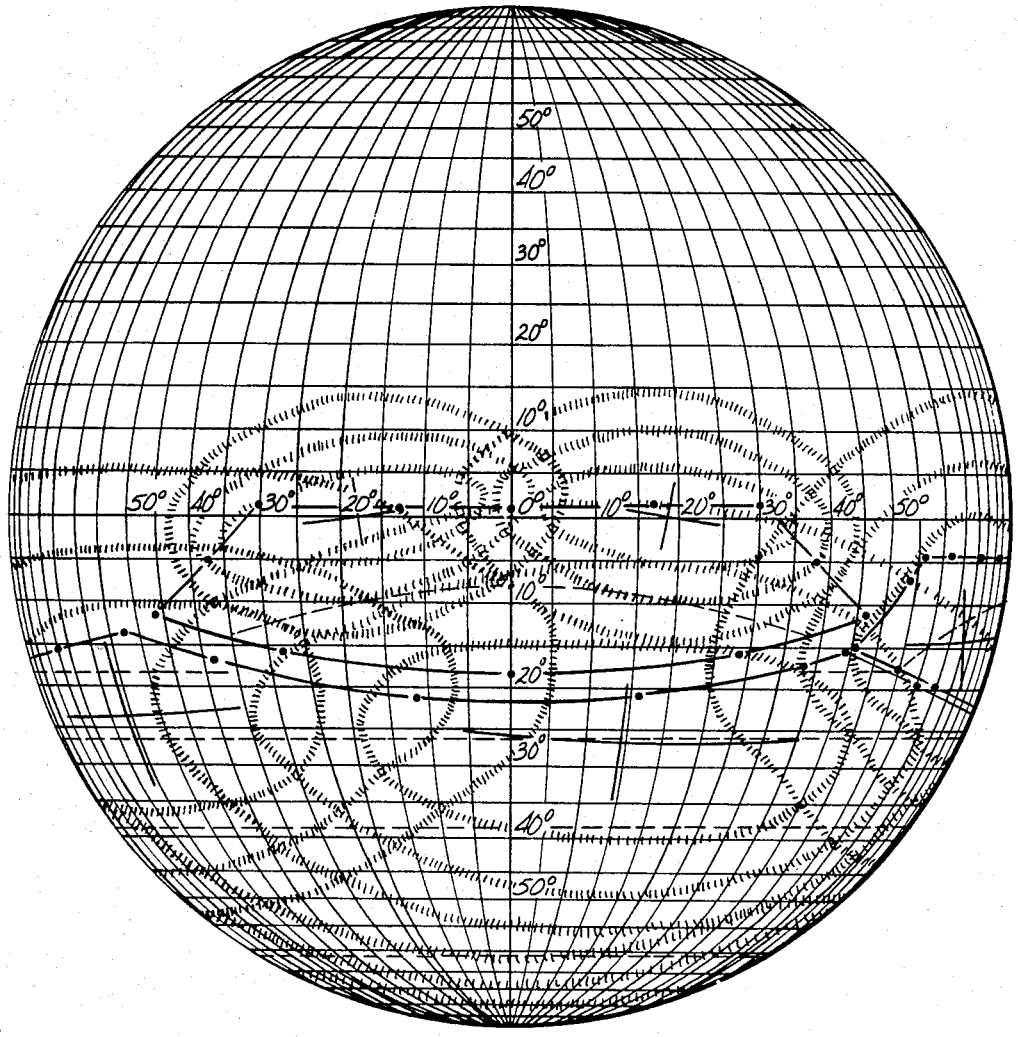
FIG. 7 is a view of the spherical surface on which a complex listening area is plotted in dash-dot lines, with five speaker overlays in dotted lines, the central axis of each speaker overlay being marked by a cross.

When the lamp is turned on, all of the seating bank boundaries will trace exactly around the model's seating bank boundaries. All loudspeaker patterns will be seen and attenuation contours will be clearly seen as shown in FIG. 7. By using colored loudspeaker coverage overlays, each loudspeaker's contribution can be seen separately. Mirrored surfaces can be positioned at any location on the model, and the effect of reflections can be determined. Tinted mirrors can be used to help trace reflections. If the sphere were large enough to accommodate a very bright bulb, strobe, arc lamp, or the like, the projection device could be hung in the actual room at the proposed loudspeaker location, and all coverage patterns could be seen as they are projected onto the building itself.

Any overlay can be moved while watching the exact effect the new position has on coverage and reflections, thus allowing the best engineering decision to be made about the position of the loudspeaker. The sphere projector also serves as a dramatic method of demonstrating the loudspeaker cluster coverage to a layman.

The sphere shows the acoustical environment, the actual angle of each loudspeaker, and the interrelationships between the coverage patterns of the loudspeakers. When position selection is complete, the overlays can be securely glued directly to the sphere. Then the sphere can be permanently glued together if desired. This sphere can be set on a base becoming a complete documentation model. With the information on the sphere, a sound-system installer has complete data for determining how to position each element of the loudspeaker cluster.

Figure 5:
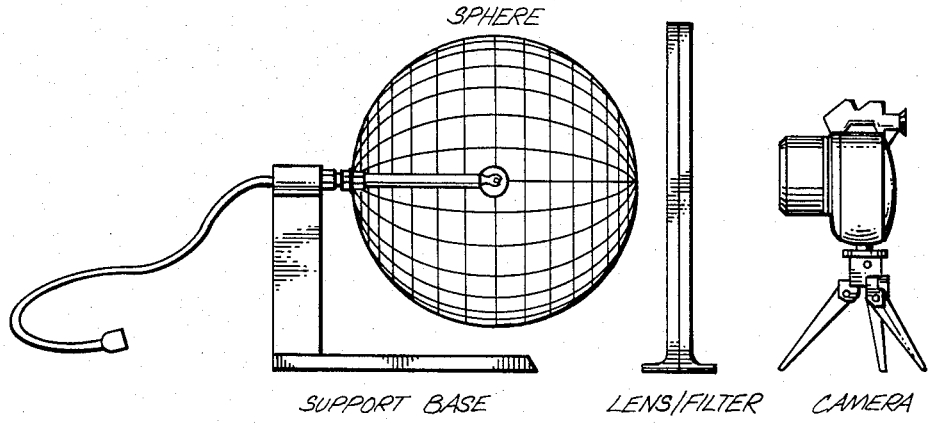
FIG. 5 is a side view of the assemblies shown in FIGS. 3 and 4 positioned for photographing of a projected image of the sphere markings on the projection screen.

A second method of documentation enables a "flat" copy to be mailed or filed. It utilizes the projection capabilities of the sphere, a screen (consisting of a lens and filters) and a camera as shown in FIG. 5. The sphere (with light assembly attached) is placed on its support base and turned on. The angle between the screen and the lamp assembly is adjusted to be parallel for the best symmetry on the screen. Then a picture is taken of the sphere through the screen at the four cardinal points and the south pole. The purpose of the screen is to provide a flat surface for the best possible photographic reproduction. The lens and filters within the screen cause the image photographed to have relatively equal light intensity.

Although the shapes on the sphere are distorted on the screen, so are the shapes of the overlays, preserving all interrelationships. The design is now completely documented with five color photographs. These photographs can be mounted side by side on a flat sheet of paper, or they can be put together in a cube to give a better sense of direction. By moving the source of light within the sphere, by using different screen sizes, or by varying the angles of projection, various forms of projection can be made.

The following description is for a system utilizing a sphere based on one-fourth inch equaling five degrees at the equator to conform to data already commercially available. The sphere may be of any size, but if a different size is used, the associated equipment must be changed to maintain the proper scale and relationship. Different types of light sources and power supplies may also be used as well as different calibration increments on the sphere.

Figure 2:
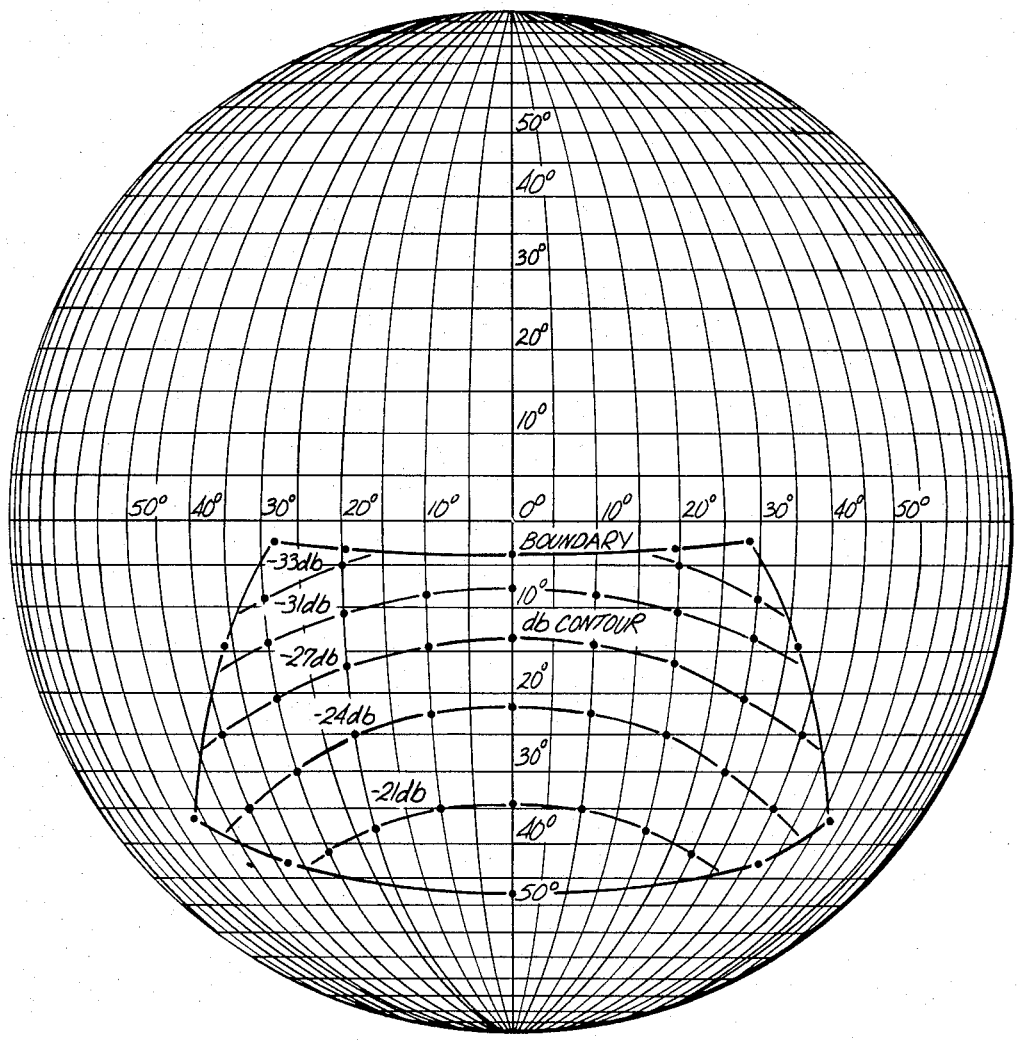
FIG. 2 is a view of the spherical surface on which the outline of a listening area is plotted, the distance from the loudspeaker to specific points in the listening area being plotted as decibel contour lines.
Figure 3:
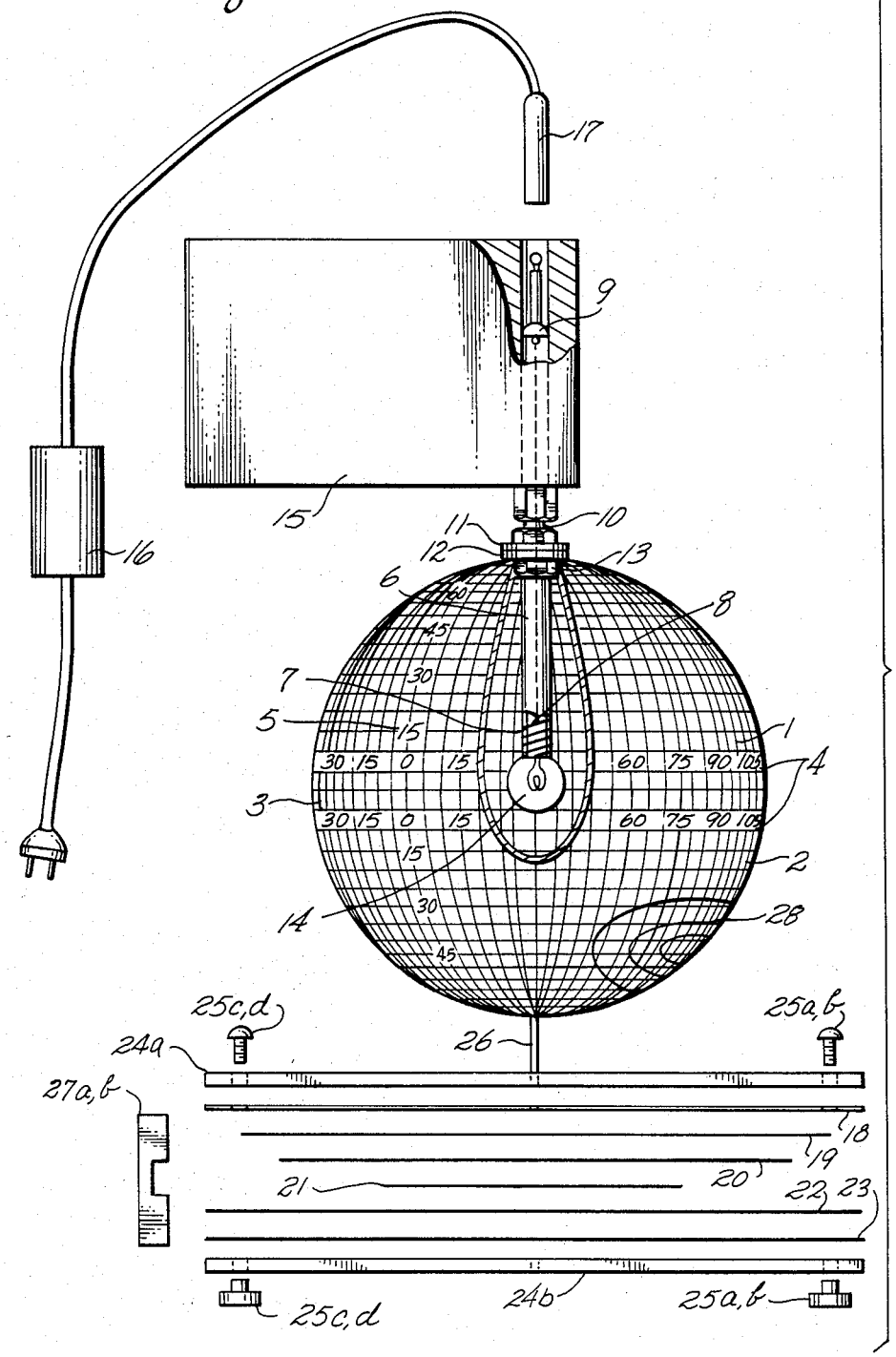
FIG. 3 is a side view of the sphere, with the addition of a light source at the spherical center, and a projection screen assembly.

Referring to FIGS. 2 and 3, the sphere assembly consists of two injection-molded plastic hemispheres 1 and 2 with $\frac{1}{8}$-inch-thick walls, and an outside diameter of 5.73 inches. The hemispheres are fastened together by using removable clear polyethylene tape 3, so the hemispheres may be joined together or detached. Lines of longitude and latitude, parallels and meridians, are marked at five degree increments; and all calibrations are imprinted in the molding process. Hemisphere 1, corresponding to the northern hemisphere on a world globe, has a one-inch hole at the pole, the 90 degree point. The sphere is calibrated in 15 degree increments 4 from zero degrees to 180 degrees horizontally clockwise, and from zero degrees to 180 degrees counterclockwise. Both hemispheres are calibrated in 15 degree increments 5 from zero degrees at the equator to 90 degrees at the pole. This completes the sphere assembly.

The lamp assembly (FIG. 3) includes a brass tube 6 ½ inch in diameter and six inches long. The tube has the threaded outer conductor 7 of a standard miniature screw lamp socket soldered to its inside wall, 3/16 inch from the end of the brass tube. The center conductor of the lamp socket is soldered to a wire 8 which runs up the length of the tube and is soldered to the tip connection of the ¼ inch male connector 9 at the opposite end of the tube. The threaded outer sleeve connection of the connector is inserted until it is flush with the tube, and is then soldered directly to the interior of the brass tube.

The entire brass-tube assembly is then put into a ½ inch coupling union 10 which has the center stop drilled out. This allows the tube to slide completely through the coupling union. The side of the coupling union toward the connector is unaltered. The side of the coupling union toward the lamp has the pressure nut unscrewed, and the ferrule has been removed. A spacing washer 11, ⅞ inch in diameter, ⅛ inch thick, with an 11/16 inch diameter center hole, is put over the threaded end of the coupling union. Then a plug button 12, with its center drilled out to 11/16 inch diameter, is fitted over the threaded end of the coupling union, with its protruding fingers pointing toward the lamp socket. Next the pressure nut 13 is screwed on firmly.

Then a light source, for example, a General Electric No. 157 lamp, 5.8 volt and 1.1 amp, with a miniature screw base lamp 14, is screwed into the lamp socket. The one-inch-diameter plug button fits snugly into the one-inch hole in the sphere. This plug button allows the easy insertion and removal of the light assembly. The modified union coupling is adjustable so the lamp can be centered correctly in the sphere. This completes the lamp assembly.

A stand 15 which supports the lamp and the sphere assembly is made of a block of hardwood which has a height of 6⅜ inches, a width of 2½ inches, and and a depth of 3¾ inches. A hole 1 17/32 inches in diameter is drilled through the depth of the wood block 5.84 inches from its base. The hole is centered 1¼ inches in from the side. The end with the electrical connector is inserted into the hole in the block of wood which then supports the entire lamp and sphere assembly. An electrical power source 16 of 5.8 volts with a female in-line connector is plugged onto the electrical connector of the brass tube assembly.

Figure 4:
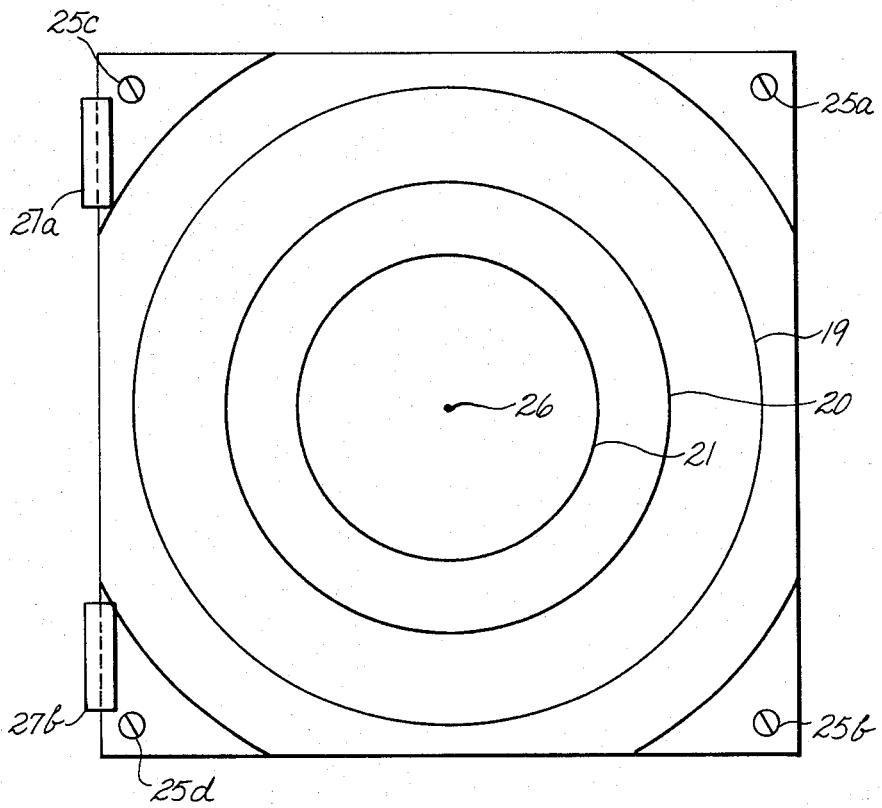
FIG. 4 is an elevation view of the projection screen assembly.

A documentation screen assembly (FIGS. 3 and 4) consists of a four-inch focal length Fresnel lens 18 of 12 inches in diameter having eighty grooves per inch. The lens has been cut down to 11×11 inches for greater portability. This lens collimates the light source. Next to the grooved side of the lens is a group of three 0.3 neutral-density filters 19, 20, and 21, which respectively are 4.78, 3.36, and 2.31 inches in radius. These mark the 30 degree, 40 degree, and 50 degree increments, and insure even light intensity.

Next to the neutral-density filters is an 11×11-inch one-half C.T. blue color correction filter 22. This filter enables the designer to take photographs, with acceptable color rendition, of the image projected on the screen, while using standard daylight color film. Next to the color correction filter is an 11×11-inch piece of 3M rear projection material 23. This serves as the actual screen surface.

This entire lens assembly is sandwiched between two sheets 24*a* and 24*b* of hard acrylic plastic, 11×11 inches, and ⅛-inch thick. The complete screen assembly is then clamped together with four ¼-inch post and peg fasteners 25*a,b,c,d*—one at each corner. A 1/16-inch hole is drilled through the center of the complete screen assembly. A brass index pin 26, 1/16 inch in diameter, and 1 5/16 inch long, is inserted into the drilled center hole allowing one inch of the pin to protrude from the grooved side of the screen. When the screen is used in conjunction with a sphere and the sphere's stand, the correct distance is set by having the sphere contact the index pin. The screen is held upright by two grooved wooden blocks 27*a,b*.

Molded loudspeaker sound-dispersion-coverage pattern overlays 28 are formed to exactly conform to the outside surface of the sphere. The patterns themselves are available from loudspeaker manufacturers, or may be made for specific speakers using conventional techniques. The inside diameter of the curvature of the overlay is 5.73 inches. An overlay is made by forming 0.01 inch thick clear p.p. vinyl over a 5.73 inch male mold. The contour information is transferred onto the overlay with a permanent ink marker by tracing a master pattern; the master pattern is engraved into a hemisphere by a skilled artist. The contours are marked at three, six, and nine db increments, and to show the center axis of the horn and its identification. The traced contour overlay is then cut out, and attached to the sphere with double-stick tape.

While the above description contains many specific dimensions, these should not be construed as limitations on the scope of the invention, but rather as examples of one preferred embodiment thereof. Many other variations are possible.

This system can be used in the same way for determining optimal selection of any transducers (not only loudspeakers, but microphones, etc.) in any given acoustical environment and/or relating any given acoustic environment to any sound source (piano, voice, etc). The system clearly determines the pattern, and sensitivity or power requirements for the transducers or sound sources.

In addition, the technique can be optionally formatted by totally automating the plotting procedure, and by utilizing the three-dimensional color graphics packages available for computers. The three-dimensional spherical model is depicted on the video screen. The room and loudspeaker coverage overlays are modeled on the sphere image on the screen. The sphere can then be rotated or tipped to any viewing angle allowing total visualization. Overlays are automatically moved and the computer distorts the overlays commensurate with the sphere image.

Accordingly, the scope of the invention should be determined, not by the embodiment illustrated, but by the appended claims and their legal equivalents.

What is claimed is:

1. A method of selection and positioning of a transducer in an environmental volume, comprising the steps of:

a. mapping selected positions in the volume on a spherical surface, the surface having a radial center representing the position of the transducer;

b. overlaying on the mapped spherical surface a mating spherical map of spatial characteristics of the transducer;

whereby a distortion-free spherical-surface composite map of the transducer characteristics and volume positions is provided to enable selection and positioning of a transducer appropriate to the positions.

2. The method of claim 1 wherein the volume mapping step includes mapping of the positions on the spherical surface of lines emanating from the radial center and extending toward the selected positions, and mapping of distance from the spherical center to the selected positions.

3. The method of claim 2, wherein the mating spherical map includes contours representing transducer performance at a plurality of distances from the transducer.

4. The method of claim 3 wherein the transducer is a loudspeaker.

5. The method of claim 4 wherein said distances are plotted in terms of decibels.

6. The method of claim 3, and further comprising the step of projecting the composite map onto a flat surface to form a two-dimensional image in which the overall map is distorted, but overlapped aligned points of the volume and transducer maps remain overlapped and aligned.

7. The method of claim 6, and further comprising the step of photographing the projected image.

8. An assembly for determining optimum positioning of a transducer in an environmental volume, comprising:

means defining a spherically curved surface, having a center of curvature simulating transducer position, the spherical surface bearing markings defining a map of the volume as viewed from the transducer position; and a spherically curved first overlay sheet having a center of curvature and radial dimension corresponding to that of said surface, the sheet being fitted over and against said surface, the sheet bearing markings defining a map of spatial characteristics of the transducer.

9. The assembly defined in claim 8, wherein said means is a hollow transparent shell, and the overlay sheet is transparent.

10. The assembly defined in claim 9, wherein the hollow shell includes marking means defining longitude and latitude coordinates on the surface.

11. The assembly defined in claim 10, wherein the volume and transducer maps include markings indicative of distance from said common center of curvature.

12. The assembly defined in claim 11, and further comprising at least one additional overlay corresponding in geometry to said first sheet, and bearing markings defining a map of spatial characteristics of a second transducer.

13. The assembly defined in claim 11, and further comprising a light source positioned at said common center of curvature.

14. The assembly defined in claim 13, and further comprising a screen assembly positioned adjacent the spherical surface to display an image of the overlapped maps as illuminated by the light source.

15. The assembly defined in claim 14, wherein the screen assembly includes a Fresnel collimating lens.

16. The assembly defined in claim 15, wherein the screen assembly further includes a plurality of juxtaposed neutral-density filters of differing outline dimensions.

* * * * *